US005169344A

United States Patent [19]

Farmer et al.

[11] Patent Number: 5,169,344

[45] Date of Patent: Dec. 8, 1992

[54] BACKSHELLS

[75] Inventors: Gerrard G. Farmer, Sherborne; Gary R. Cashmore, Yeovil, both of England

[73] Assignee: Westland Helicopters, Ltd., England

[21] Appl. No.: 628,418

[22] Filed: Dec. 17, 1990

[30] Foreign Application Priority Data

Dec. 15, 1989 [GB] United Kingdom ..... 8928357

[51] Int. Cl.[5] ..... H01R 9/03

[52] U.S. Cl. ..... 439/610

[58] Field of Search ..... 439/607, 608, 609, 610, 439/92, 95, 96, 98, 108, 105

[56] References Cited

U.S. PATENT DOCUMENTS

| | | | |
|---|---|---|---|
| 3,391,381 | 7/1968 | Livingston | 439/610 |
| 3,448,430 | 6/1969 | Kelly | 439/610 |
| 3,622,952 | 11/1971 | Hilbert | 439/610 |
| 4,678,259 | 7/1987 | Petit | 439/610 |
| 4,808,128 | 2/1989 | Werth | 439/610 |
| 4,830,628 | 5/1989 | Dyson et al. | 439/610 X |
| 4,854,891 | 8/1989 | Kamei et al. | 439/610 X |

*Primary Examiner*—Neil Abrams
*Assistant Examiner*—Khiem Nguyen
*Attorney, Agent, or Firm*—Larson & Taylor

[57] ABSTRACT

A backshell for connecting screened multi-core cables includes a tubular body portion which in a preferred embodiment includes a plurality of circumferentially arranged holes one of which, in use, receives the free end of an electrically conductive ribbon wound round the wires of the cable and in contact with their individual screens. Rotation of the body portion winds the ribbon around the periphery of the cable until the space is filled, the ribbon being wound externally round the tubular body portion and secured with termination means whereby the individual screens are connected electrically to the backshell. Attachment means facilitate attachment of the backshell either to a cylindrical connector body or to a hollow box member for connection in turn to a rectangular connector body.

17 Claims, 4 Drawing Sheets

BACKSHELLS

BACKGROUND OF THE INVENTION

1. Field of the Invention

This invention relates to backshells particularly for use in connecting screened multi-core cables to a connector body.

2. Description of the Prior Art

UK-A-2199198 discloses a backshell having a cylindrical tubular body portion which in one embodiment includes an integral cylindrical end portion having a slot extending from one end and generally parallel to a longitudinal axis for receiving one end of an electrically conductive ribbon wound round the cables. The end portion is provided with an external coarse thread to receive an internally threaded termination nut which serves to trap a free end of the ribbon. The body portion has a rotatable internally threaded coupling nut for connecting the backshell to a cylindrical externally threaded connector body and, usually some form of cable clamp is required. Such backshells are complex and the requirement for the separate termination nut increases the weight.

Also, other types of connector body that are not cylindrical are being increasingly used especially in the aircraft industry. An example is the ARINC 404 connector body which has one or more connector blocks mounted on a rectangular support plate. In use the support plate is usually bolted to a flat apertured mounting panel.

The backshell of UK-A-2199198 is not suitable for use in connecting a cable to such a connector body.

SUMMARY OF THE INVENTION

It is therefore one objective of this invention to provide a backshell that is simpler and lighter than the prior device. Another objective is to provide a backshell that is suitable for use in connecting a screened multi-core cable to a non-cylindrical connector body.

Accordingly in one aspect, this invention provides a backshell for a connector for a multi-core cable having a plurality of individual conductor screens, the backshell including an electrically conductive generally cylindrical tubular body portion having at least one hole through a wall thereof, the arrangement being such that a multi-core cable may be threaded through said body portion and an electrically conductive ribbon passed through the or a said hole into contact with each individual screen of the cable, whereby the ribbon may be wound about the cable by rotation of the body portion relatively thereto until the ribbon winding fills the space between the periphery of the cable and the internal surface of the body portion, a free end of the ribbon protruding from the hole enabling the ribbon thereafter to be secured around the external surface of the body portion by termination means thereby to connect the individual screens of the cable electrically to the backshell.

Conveniently, the dimensions of the backshell and the size of the or each hole therein is such that as the space fills the ribbon bulges outwardly into the or each hole sufficient to prevent relative axial movement between the multi-core cable and the body portion.

Preferably, the termination means comprise a simple and replaceable cable strap located externally of the ribbon wound around the external surface of the tubular body portion.

In one form of this embodiment the or each hole is circular and preferably four such holes are equi-spaced circumferentially of the tubular portion.

The backshell may include an internally threaded freely rotatable coupling nut at one end of the tubular body portion for attaching the backshell to an externally threaded end of a generally cylindrical connector body having a multi-pin connector at its other end.

Alternatively, the backshell may include a hollow rectangular electrically conductive box member having an open end and attachment means for connection to a rectangular connector body, said tubular body portion located through a hole in one of the walls of the box member and having a radially extending flange at one end for location internally of the wall and an adjacent externally threaded portion for engagement externally of said wall by an internally threaded lock nut.

In such an arrangement the attachment means may comprise attachment flanges along two opposed sides of the open end of the box member. The remaining two edges may be provided with forwardly protruding lip portions for location, during operation, throughout the thickness of an aperture in a panel on which the connector is fitted.

In another aspect, this invention provides a backshell for a connector for a multi-core cable having a plurality of individual conductor screens the backshell including a hollow box member having an open end with attachment means for attachment during operation to a mounting panel, an electrically conductive cylindrical tubular body portion rotatably mounted in one of the walls of the box member and having at least one aperture in a wall thereof, termination means for securing a conductive ribbon to the exterior of the tubular body portion and locking means for selectively locking the body portion to the box member, the arrangement being such that a multi-core cable may be threaded through the body portion and an electrically conductive ribbon passed through the or a said aperture into contact with each individual screen of the cable, whereby the ribbon may be wound about the cable by rotation of the body portion relatively thereto until the ribbon winding fills the space between the periphery of the cable and the internal surface of the body portion, the ribbon thereafter being secured around the external surface of the body portion by said termination means and said tubular portion being locked to said box member thereby to connect the individual screens of the cable electrically to the backshell.

In one embodiment the aperture may comprise a slot extending from an end of the tubular body portion and generally parallel to a longitudinal axis of the body portion. The termination means may comprise a termination nut having an internal coarse thread for mating with an external thread on the tubular body portion.

In another embodiment the aperture may comprise at least one hole through the wall of the tubular body portion and the termination means may comprise a simple replaceable cable strap located circumferentially around the ribbon on the tubular body portion in the vicinity of the or each hole. Preferably four equi-spaced holes are provided circumferentially of the tubular body portion, and the holes are circular.

The tubular body portion may be located through a hole in a wall of the box member and the locking means may comprise a radial flange at one end for engagement against an inner surface of the wall and a locknut for engagement on a threaded portion on the body portion for tightening against an external surface of said wall thus providing a sound electrical bond and RF seal.

A connector for a multi-core cable having a plurality of individual conductor screens, the connector comprising a backshell including an electrically conductive generally cylindrical tubular body portion having at least one hole through a wall thereof, the arrangement being such that a multi-core cable may be threaded through said body portion and an electrically conductive ribbon passed through the or a said hole into contact with each individual screen of the cable, whereby the ribbon may be wound about the cable by rotation of the body portion relatively thereto until the ribbon winding fills the space between the periphery of the cable and the internal surface of the body portion, a free end of the ribbon protruding from the hole enabling the ribbon thereafter to be secured around the external surface of the body portion by termination means thereby to connect the individual screens of the cable electrically to the backshell.

BRIEF DESCRIPTION OF THE DRAWINGS

The invention will now be described by way of example only and with reference to the accompanying drawings in which.

DETAILED DESCRIPTION OF THE DRAWINGS

Figure 1:
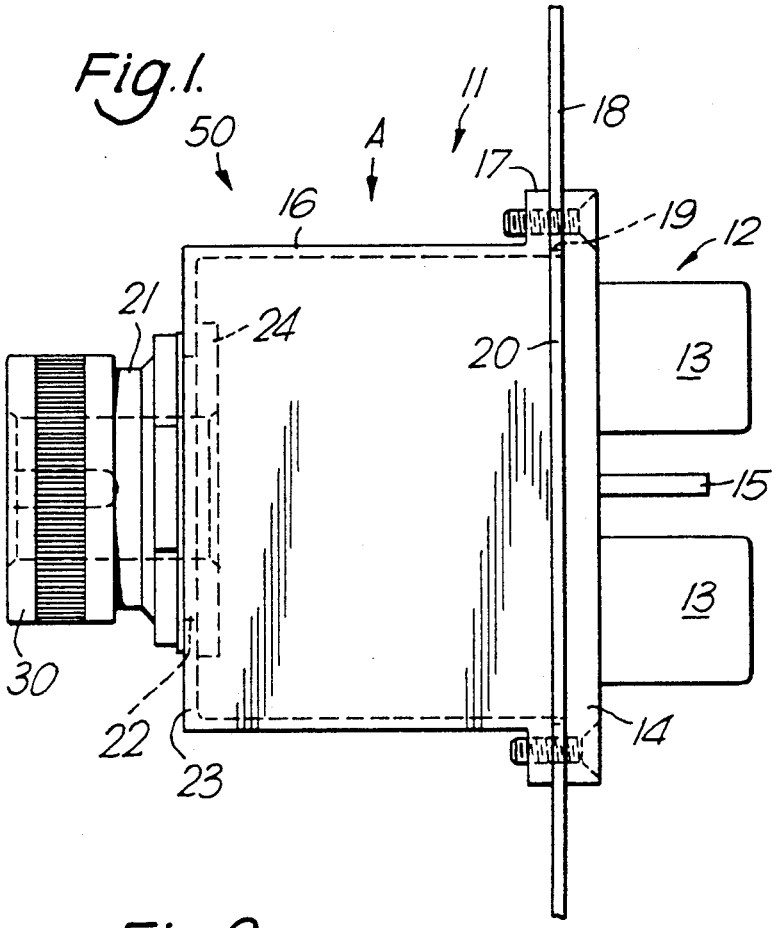
FIG. 1 is a side view of a connector incorporating a backshell and constructed according to one embodiment of the invention.

Referring now to FIG. 1, a connector generally indicated at 11 includes a panel mounted rectangular connector body 12 and a backshell 50 adapted for use in connecting a screened multi-core cable (not shown) to the connector body 12 which may comprise an ARINC 404 type connector having a single, dual or triple insert 13 attached to a rectangular support plate 14. Three polarising posts 15 (one only being shown) usually protrude from the plate 14 to assist correct mating of the connector body 12.

Backshell 50 comprises a hollow rectangular metal electrically conductive box member 16 having an open end which is provided along two opposed sides with attachment flanges 17. The flanges have threaded holes engaged by countersunk screws through mating holes in connector support plate 14 and a generally flat mounting panel 18. Panel 18 has a generally rectangular aperture 19 for passage of the multi-core cable to the connector inserts 13.

Figure 2:
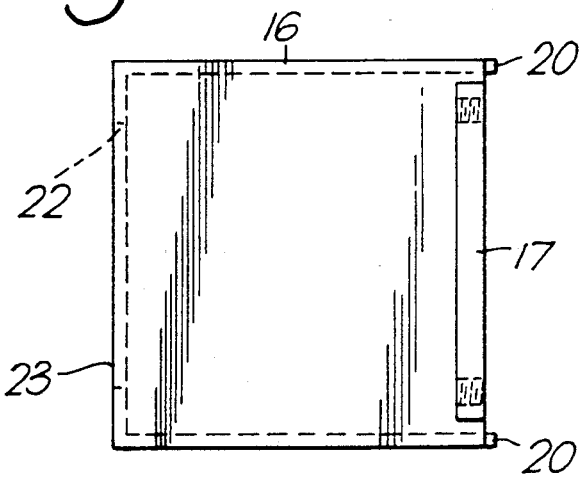
FIG. 2 is a fragmentary plan view taken in the direction of Arrow A of FIG. 1 showing part of the backshell.

As shown also in FIG. 2, the remaining two opposed edges of box member 16 are provided with forwardly protruding lip portions 20 which on assembly locate within the aperture 19 in panel 18 and throughout its thickness.

Figure 3:
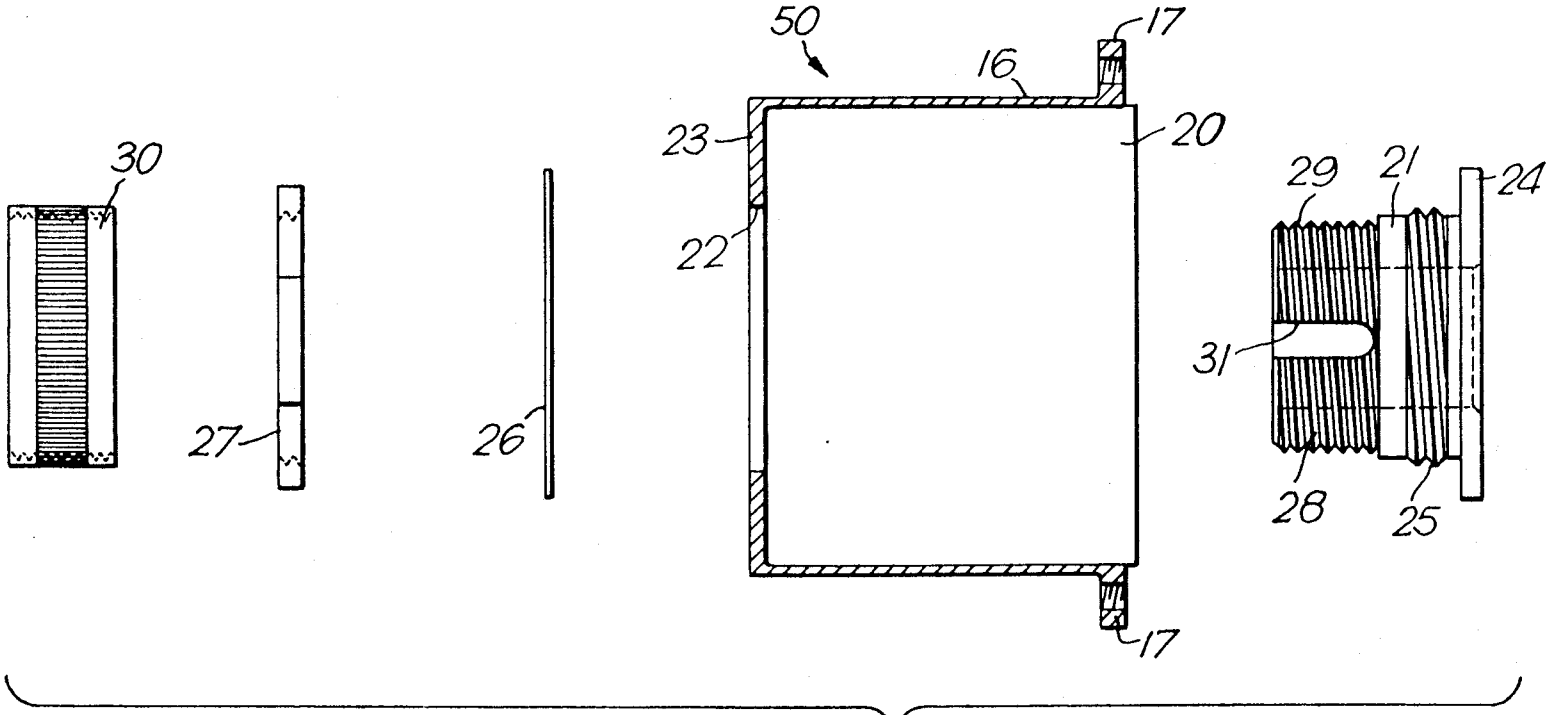
FIG. 3 is an exploded view of the backshell of FIGS. 1 and 2.

Backshell 50 further includes a cylindrical tubular body portion 21 rotatably located through a circular hole 22 in a rear wall 23 of the box member 16. Reference should be made to FIGS. 1 and 3 for detailed description.

Body portion 21 has a radially extending flange 24 at one end and an adjacent externally threaded portion 25 for engagement externally of the rear wall 23 by a washer 26 and an internally threaded lock nut 27. Tightening of nut 27 serves as locking means to lock the body portion 21 to the box member 16 and loosening of the nut 27 serves to permit rotation of the body portion 21 in box member 16.

The other end 28 of the body portion 21 has an external coarse thread 29 for engagement by termination means comprising an internally threaded termination nut. A slot 31 extends inwardly from an open end coincident with the end 28 of tubular body portion 21 and generally parallel to its longitudinal axis.

In operation, the winding of an electrically conductive ribbon (not shown) around the multi-core cable internally of the body portion 21 similarly to the disclosure of UK-A-2199198 is achieved by loosening of the locking nut 27 and rotation of the body portion 21. The ribbon is wound externally around the body portion 21 and retained by the termination nut 30. Locking nut 27 is tightened to lock the body portion 21 to the box member 16.

Thus, this invention provides a backshell 50 which facilitates the connection of a screened multi-core cable to a non-cylindrical connector body 12.

Another important feature of backshell 50 concerns the protruding lip portions 20 on box member 16 located in the aperture 19 in panel 18 which serves to block effectively a potential RF leakage path that would otherwise occur between a butted surface location between the open end of box 16 and the surface of panel 18.

In use it is usually desirable to provide strain relief means to prevent inadvertent detachment of the cable from connector body 12 by pulling of the cable through the tubular body portion 21. In the embodiment hereinbefore described this requires the provision of additional means such as bolted cable clamps extended outwardly from the termination nut 30 for clamping around the cable.

Figure 4:
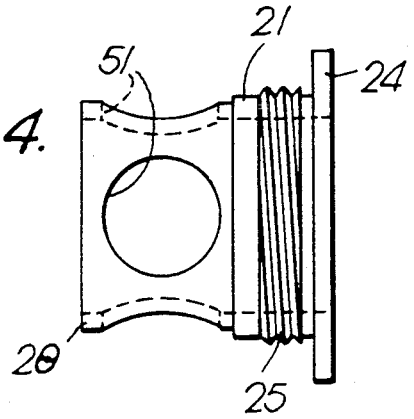
FIG. 4 is a side view of a modified form of backshell.

In the embodiment of FIG. 4 and the end 28 of tubular body portion 21 has a plain external surface and four equi-spaced circular holes 51 are located circumferentially through its wall portion. In one such construction the tubular portion 28 may have an external diameter of about 25 mm and the diameter of the holes may be about 15 mm.

Figure 7:
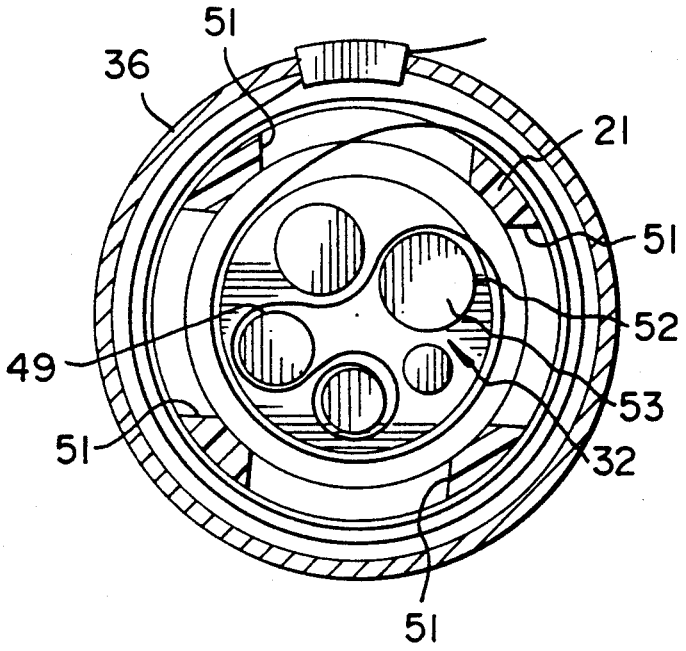
FIG. 7 is a schematic transverse cross-sectional view taken through the part shown in FIG. 5.

Operation of the embodiment of FIG. 4 will be described with reference to FIGS. 5 and 7. Thus, an electrically conductive ribbon 49 is in contact with each individual conductor screen 52 of all the wires 53 of a multi-core cable 32 passing through the body portion 21, and a free end is located through one of the circular holes 51 in tubular body portion 21. As before, rotation of the body portion 21 serves to wrap the ribbon 49 around the multi-core cable 32 internally of the body portion as indicated at 33 to ensure, once the space is tightly filled, a radio frequency (RF) current path from the cable screens to the body portion 21 of backshell 50.

Figure 5:
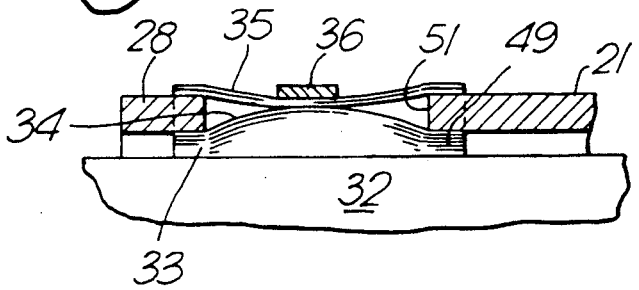
FIG. 5 is a fragmentary side view of part of FIG. 4 and on an enlarged scale.

In the illustrated embodiment the dimensions of the backshell 50 and the diameter of the holes 51 is such that as the space between the external surface of cable 32 and the internal surface of tubular portion 21 fills, the ribbon bulges outwardly into each of the holes 51 as shown at 34 in FIG. 5. The free end of the ribbon is then wrapped around the plain external surface of tubular portion 21 as shown at 35 so as to cover the four holes 51, and is secured by termination means comprising a simple cable strap 36 which pulls the outer ribbon portion inwardly into the holes 31 to contact the bulged portions 34. It is to be understood that the bulged portions 34 are not shown in the somewhat exploded view of FIG. 7 because the number of windings of ribbon 49 internally of the tubular body portion 21 has been minimized in order to improve the clarity and to show the path followed by the ribbon 49.

In this embodiment, the interference between the bulged portions 34 of the ribbon and the edges of the holes 51 provides automatic cable clamping and an efficient strain relief function by preventing relative axial movement between the wrapped cables 32 and the body portion 21. Thus both efficient screening and clamping is accomplished with the use of a simple cable strap 36 which dispenses with the need for the external coarse threads on tubular portion 28 and the internally threaded termination nut 30 and attached cable clamps of the previous embodiment to provide a simpler and lighter assembly.

Whilst described with reference to a backshell 11 for connecting to non-cylindrical connector bodies, it will be apparent that the embodiment of FIG. 4 can also be used with similar advantage in a backshell for use in connecting a screened multi-core cable to a cylindrical connector body.

Figure 6:
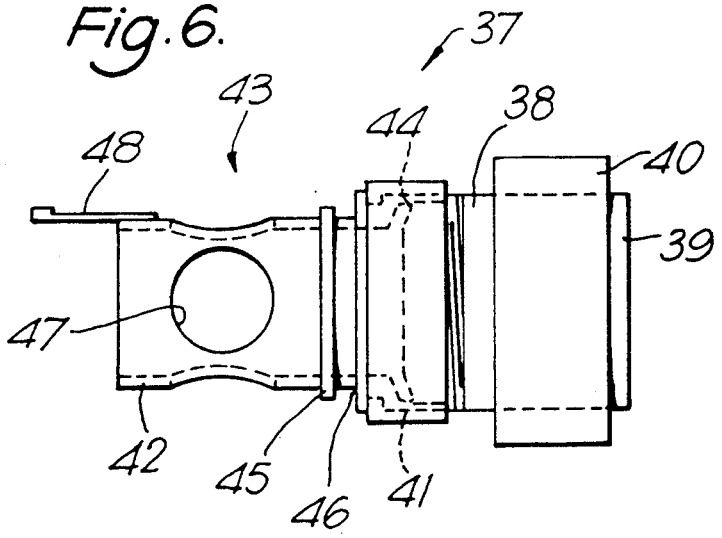
FIG. 6 is a side view of a cylindrical connector incorporating a backshell similar to that of FIGS. 4 and 5.

One embodiment of such a connector will now be described with reference to FIG. 6. Connector 37 includes a generally cylindrical connector body 38 having a multi-pin connector 39 at one end thereof adapted during operation to receive the ends of individual cables in a multi-core cable in known manner. A relatively rotatable coupling nut 40 is located on the connector body 38 and, in use, facilitates attachment of connector 37 to apparatus (not shown) to which the cable is to be connected via a mating connector part.

The other end of connector body 38 is threaded externally to receive an internally threaded end of a coupling nut 41 freely rotatable on one end of a tubular body portion 42 of a backshell 43. When fully engaged, anti-rotation teeth 44 on adjacent ends of connector body 38 and backshell body 42 prevent relative rotation of the parts. A radially extending lip 45 defines a groove 46 at an inner end of tubular body 42 for engagement during operation by an inner end of a protective sleeve (not shown).

Four equi-spaced holes 47 are provided through the wall of the tubular body portion 42 similar to the holes 51 of the embodiment of FIGS. 4 and 5 and are used in an identical manner to that described with reference to that embodiment.

A strain relief post 48 extends from the end of tubular body portion 42 and in use provides an anchor for a cable strap around the multi-core cable to prevent chafing of the cables.

Whilst several embodiments of the invention have been described and illustrated it will be understood that many modifications may be made without departing from the scope of the invention as defined in the appended claims. For example, the hollow box member 16 may have any appropriate cross-sectional shape other than the rectangular shape described and could, conceivably, be circular in cross section. The holes 51 and 47 may be other than circular and may for example be oval, and the number of holes used and their diameter will vary with the diameter of the backshell body portions 28 and 42. In small diameter backshells the size of the or each hole 47 or 51 may necessarily be reduced such that bulging of the ribbon into the holes sufficient to prevent relative axial movement may be prevented so that additional cable clamp means may be required. The connector 37 of FIG. 6 can with suitable angled extension means be converted to angled configurations such as 45 and 90 degree connectors.

What is claimed is:

1. A backshell for a connector for a multi-core cable having a plurality of individual conductor screens, the backshell including an electrically conductive generally cylindrical tubular body portion having at least one hole through a wall thereof, a multi-core cable threaded through said body portion with a space being formed between the periphery of the cable and the internal surface of the body portion and an electrically conductive ribbon passed through said hole into contact with each individual screen of the cable, the ribbon being wound about the cable by rotation of the body portion relatively thereto to form a ribbon winding which fills the space between the periphery of the cable and the internal surface of the body portion, a free end of the ribbon protruding from the hole, termination means securing the ribbon around the external surface of the body portion to connect the individual screens of the cable electrically to the backshell.

2. A backshell as claimed in claim 1, wherein the dimensions of the backshell and the size of the hole therein is such that as the space fills the ribbon bulges outwardly into the hole sufficient to prevent relative axial movement between the multi-core cable and the body portion.

3. A backshell as claimed in claim 1, wherein the termination means comprise a cable strap located externally of the ribbon wound around the external surface of the tubular body portion.

4. A backshell as claimed in claim 1, wherein the hole is a circular hole.

5. A backshell as claimed in claim 1, wherein four holes are equi-spaced circumferentially of the tubular body portion.

6. A backshell as claimed in claim 1, and including an internally threaded freely rotatable coupling nut at one end of the tubular body portion for attaching the backshell to an externally threaded end of a generally cylindrical connector body having a multi-pin connector at its other end.

7. A backshell as claimed in claim 1, wherein said backshell includes a hollow rectangular electrically conductive box member having an open end and attachment means for connection to a rectangular connector body, said tubular body portion located through a hole in one of the walls of the box member and having a radially extending flange at one end for location internally of the wall and an adjacent externally threaded portion for engagement externally of said wall by an internally threaded lock nut.

8. A backshell as claimed in claim 7, wherein said attachment means comprise attachment flanges along two opposed sides of the open end of the box member.

9. A backshell as claimed in claim 8, wherein the remaining two opposed edges of the box member are provided with forwardly protruding lip portions for location, during operation, throughout the thickness of an aperture in a panel on which the connector is fitted.

10. A backshell for a multi-core cable having a plurality of individual conductor screens, the backshell comprising an electrically conductive hollow box member having an open end, attachment means for attachment of said hollow box member during operation to a mounting panel, an electrically conductive tubular body portion rotatably mounted in one of the walls of the box member, said box member having at least one aperture in a wall thereof, termination means for securing a conductive ribbon to the exterior of the tubular body portion and locking means for selectively locking the tubular body portion to the box member, a multi-core cable being threaded through said body portion with a space being formed between the periphery of the cable and the internal surface of the body portion and an electrically conductive ribbon passed through said aperture into contact with each individual screen of the cable, whereby the ribbon is wound about the cable by rotation of the body portion relatively thereto to form a ribbon winding which fills the space between the periphery of the cable and the internal surface of the body portion, the ribbon thereafter being secured around the external surface of the body portion by said termination means and said tubular portion being locked to said box member thereby to connect the individual screens of the cable electrically to the backshell.

11. A backshell as claimed in claim 10, wherein said aperture comprises a slot extending from an end of the tubular body portion and generally parallel to a longitudinal axis of the body portion.

12. A backshell as claimed in claim 11, wherein said termination means comprise a termination nut having an internal coarse thread for mating with an external coarse thread on the tubular body portion.

13. A backshell as claimed in claim 10, wherein said aperture comprises at least one hole through the wall of the tubular body portion.

14. A backshell as claimed in claim 13, wherein said termination means comprise a cable strap located circumferentially around the ribbon on the body portion and in the vicinity of the or each hole.

15. A backshell as claimed in claim 13, wherein said aperture comprises four equi-spaced holes located circumferentially of the tubular body portion.

16. A backshell as claimed in claim 10, wherein said tubular body portion is located through a hole in a wall of the box member and said locking means comprises a radial flange at one end for engagement against an inner surface of the wall and a lock nut for engagement on a threaded portion of the body portion for tightening against an external surface of the wall.

17. A connector for a multi-core cable having a plurality of individual conductor screens, the connector comprising a backshell including an electrically conductive generally cylindrical tubular body portion having at least one hole through a wall thereof, a multi-core cable threaded through said body portion with a space being formed between the periphery of the cable and the internal surface of the body portion and an electrically conductive ribbon passed through the hole into contact with each individual screen of the cable, the ribbon being wound about the cable by rotation of the body portion relatively thereto to form a ribbon winding which fills the space between the periphery of the cable and the internal surface of the body portion, termination means for securing a free end of the ribbon protruding from the hole enabling the ribbon to be secured around the external surface of the body portion thereby to connect the individual screens of the cable electrically to the backshell.

* * * * *